United States Patent [19]

Otis

[11] 3,931,931

[45] Jan. 13, 1976

[54] SURFACE WASHER

[76] Inventor: George A. Otis, 715 E. Los Angeles Drive, Vista, Calif. 92083

[22] Filed: Feb. 20, 1975

[21] Appl. No.: 551,246

[52] U.S. Cl. ..... 239/287; 239/199; 239/532; 239/566

[51] Int. Cl.[2] ..... B05B 1/20; B05B 15/06

[58] Field of Search ..... 239/159, 195, 199, 286, 239/532, 566, 287

[56] References Cited

UNITED STATES PATENTS

| | | | |
|---|---|---|---|
| 622,132 | 3/1899 | Dungan | 239/199 |
| 2,692,163 | 10/1954 | Geel | 239/287 |
| 2,911,157 | 11/1959 | Converse | 239/287 |
| 3,770,210 | 11/1973 | Veltkamp | 239/532 |

*Primary Examiner*—Robert S. Ward, Jr.
*Attorney, Agent, or Firm*—Clement H. Allen

[57] ABSTRACT

A surface washer has a horizontal pipe member fitted with spaced nozzles and rotably attached at each end to a support movable on casters in all directions. At least three casters are employed to obtain a horizontally stable support and preferably four, with two casters supporting each end of the horizontal pipe. A hollow handle is attached to and communicates interiorly with the pipe member at one of its ends, the other end being fitted with a water hose connection. Preferably each caster is pivoted on a shaft in a common bearing, and which has a head rotatable in a closed socket.

10 Claims, 6 Drawing Figures

SURFACE WASHER

BACKGROUND OF THE INVENTION

1. The Field of the Invention

This invention relates to a washer which can be moved or rolled to progressively spray water over a surface such as a driveway.

2. The Prior Art

Surface washers proposed and used by the prior art have generally comprised a horizontal pipe fitted with a plurality of spaced nozzles. The pipe is supported by a caster at each end and supplied with water under elevated pressure through a handle attached thereto. The pipe can be rotated by the handle to direct the spray nearer or farther away and the device can be readily moved forward on its casters and readily moved in any direction on its casters but only when the caster shafts are in vertical position. Any rotation of the horizontal pipe to adjust the direction of the water spray throws the caster shafts off vertical and the device cannot then be moved sideways, for example. Or, if it is desired to move the washer sideways and backwards or in any direction other than that in which the trailing casters lead, then the nozzle pipe must be rotated until the caster shafts are vertical, then the washer may be moved in any direction because the caster wheels can trail properly, and, after a new location is achieved the pipe can be rotated to direct the spray from the nozzles as desired. This is, however, an inconvenient procedure. A surface washer could be moved over a surface in any direction while at the same time maintaining any angle of spray pipe rotation would be extremely advantageous. The washer could be moved as desired over the surface and the spray adjusted continuously to provide most effective cleaning.

BRIEF SUMMARY OF THE INVENTION

Summarized briefly this invention comprises a horizontal pipe fitted with a plurality of spaced-apart nozzles with a plurality of at least three and preferably four casters supporting the ends of the pipe to obtain a horizontally stable support, preferably two at each end. The horizontal pipe is rotatably attached to the caster assembly at each of its ends by a link having one of its ends fixedly attached to one of either the caster assembly or the end of the pipe, the other end of the link being rotatably attached to the other of the caster assembly or the end of the pipe. Preferably the links are rotatably attached to the caster assemblies and fixedly attached to the ends of the pipe. Preferably also, the frames of the caster assemblies are outwardly angled at the front while at the rear are parallel.

In a preferred embodiment the casters employed in the washer are pivoted on shafts mounted in common bearings, not roller or ball bearings, and with the top of the shaft mating with a closed socket, that is a socket having no oil hole or other aperture leading to the top of the shaft.

A hollow handle is attached at one end to and communicates with the interior of the horizontal pipe so that this pipe may be rotated to adjust the spray direction; the handle also serves as means to supply water under pressure to the horizontal pipe, through a hose connection at its other end.

Stops are preferably provided to bear against the links between the horizontal pipe and the caster assemblies to limit rotation of the horizontal pipe and also to maintain the hollow handle in upright stable position for storage. The handle also may be demountably attached to the horizontal pipe to provide a more compact package for shipping.

DESCRIPTION OF A PREFERRED EMBODIMENT

Figure 1:
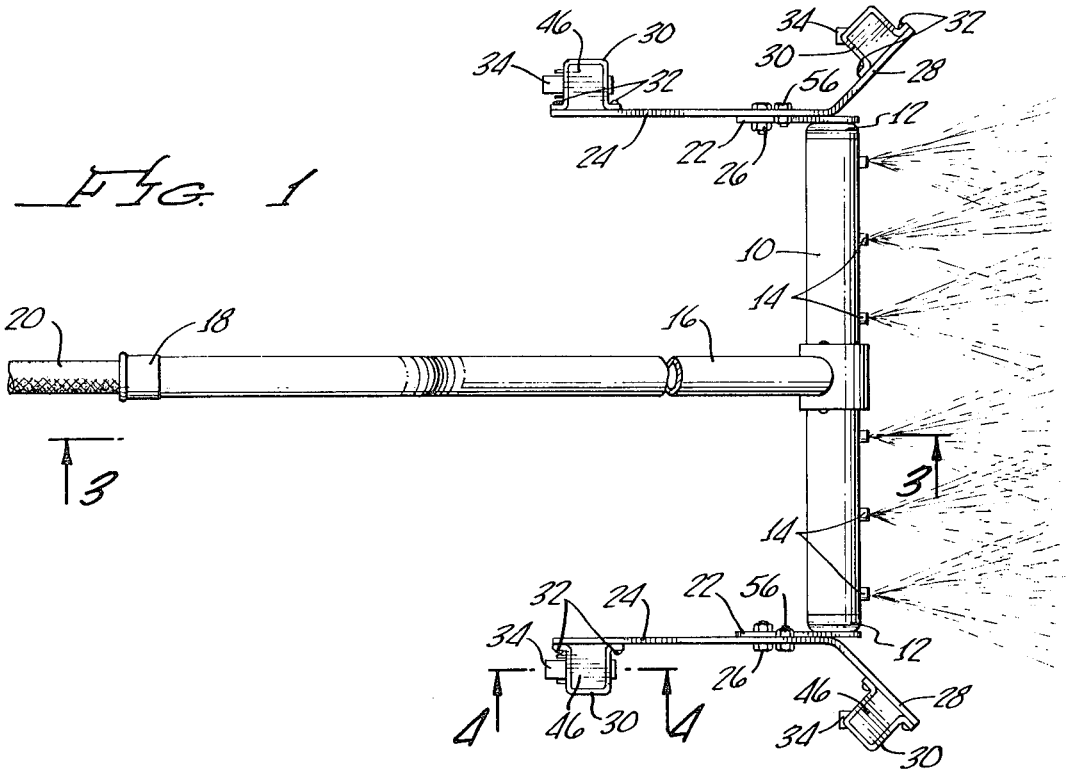
FIG. 1 shows a plan view of a surface washer embodying features of this invention.
Figure 2:
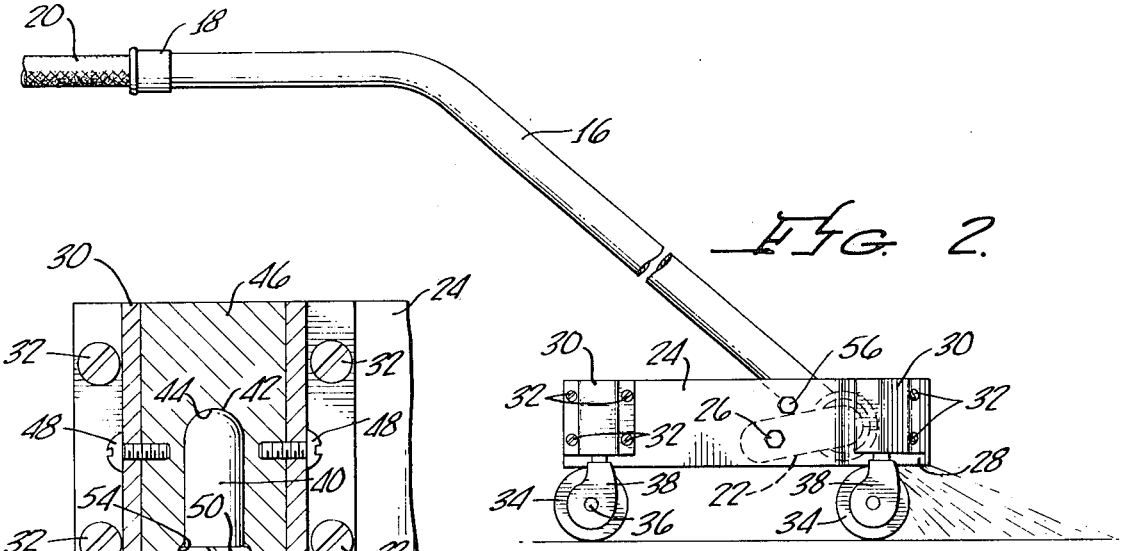
FIG. 2 shows a side view of the surface washer of FIG. 1.
Figure 3:
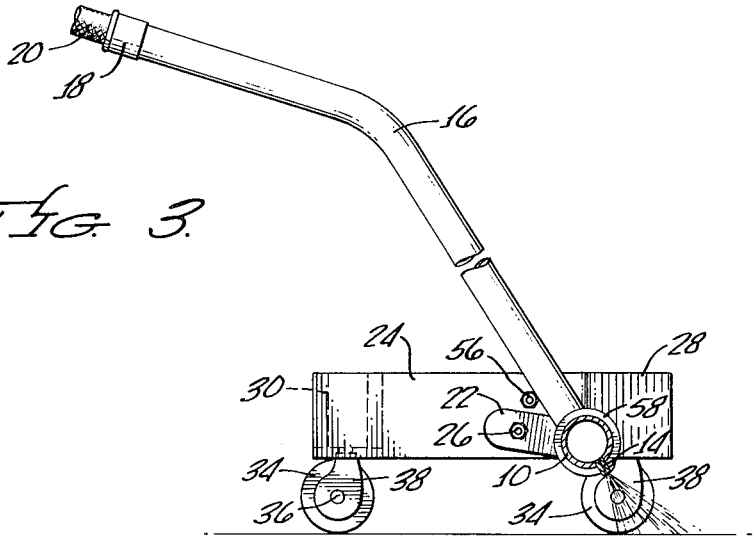
FIG. 3 shows a vertical cross section of the surface washer of FIG. 1 taken along the line 3—3 but with the handle elevated to illustrate the effect on the spray of rotation of the nozzle pipe.

Referring now to FIGS. 1, 2 and 3, the surface washer comprises a horizontal pipe 10 sealed at each end by caps 12 which may conveniently be welded or threaded on, and along whose length are arranged interiorly communicating spaced-apart nozzles 14. Attached centrally and sealed to pipe 10, as by welding, soldering, threading, or any convenient manner, or by a collar as hereinafter described, and communicating interiorly therewith, is a relatively long hollow handle 16 which is fitted at its upper end with a conventionally hose connector 18 through which water under elevated pressure may be supplied from hose 20 through handle 16, pipe 10 and out of nozzles 14 to form a wide band of sprayed water for effective cleaning purposes.

At each end of pipe 10 is attached a link 22 which may be welded to cap 12 and whose other end is rotatably attached to side plate 24 as by partly threaded bearing bolt 26. Side plates 24 form frames for the caster assemblies at each end of pipe 10 and are preferably fabricated with parallel rear portions and outwardly angled front portions 28. Attached to side plates 24 and to their outwardly angled front portions 28 are caster holders 30 which may be fastened to side plates 24 and 28 as by bolts 32.

It will be seen that the arrangement of the four casters as shown and described, with the four caster wheels spaced apart supporting the ends of nozzle pipe 10 and also spaced apart from front to back, will provide a horizontally stable support for nozzle pipe 10 so that caster wheels 34 and their shafts 36 will always remain vertical to the surface over which the washer moves regardless of the angle of rotation of nozzle pipe 10.

Figure 4:
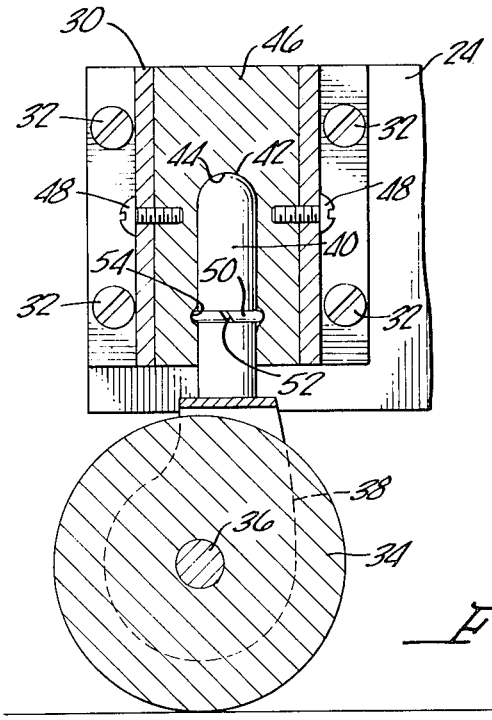
FIG. 4 shows a vertical cross section, much enlarged, of one of the caster assemblies of the surface washer of FIG. 1 taken along the line 4—4.

Details of the casters themselves will be clear from FIG. 4 wherein it is seen that each caster wheel 34 turns on its shaft 36 which is held between a pair of guide plates 38 which are joined at their tops and fixedly attached as by welding to pivot shaft 40. The top or bead 42 of each pivot shaft 40 is preferably hemispherical as shown and mates with the inside of the top of closed socket 44 in holding block 46 which is conveniently and convertically attached inside caster holders 30 as by bolts 48. A split ring 50 rides in a groove 52 in pivot shaft 40 and also in groove 54 in block 46 to hold the caster wheel and shaft from falling out of its socket 44 when the washer may be lifted from the ground. Block 46 may be fabricated of metal or a suitable plastic such as polypropylene.

Figure 5:
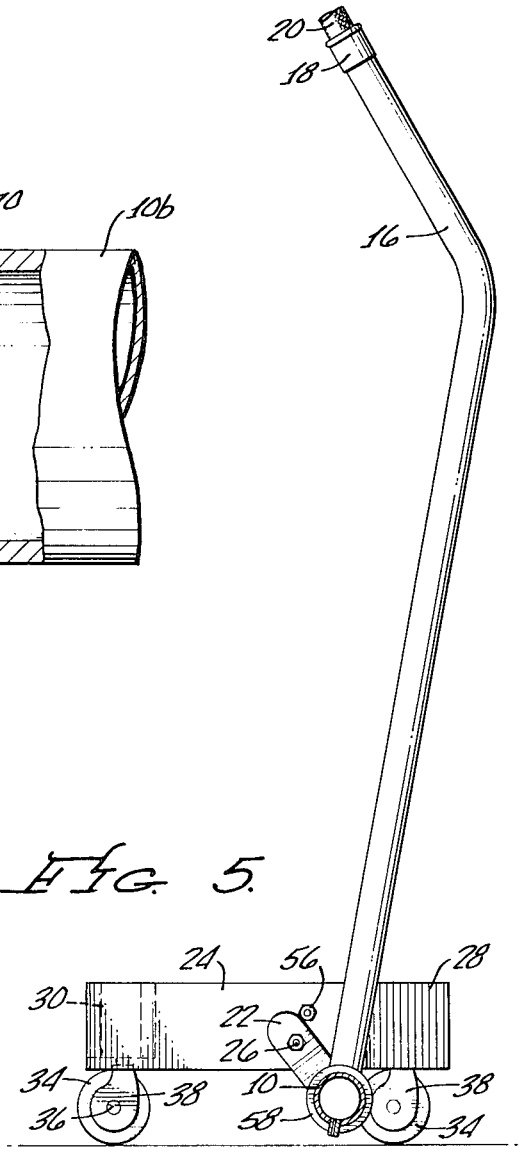
FIG. 5 shows the surface washer of FIG. 1 with its hollow handle in upright position for storage.

Stops 56, which may be studs screwed into side plates 24, are arranged above and slightly forward of link bearing bolts 26. These stops 56 bear against the outer top portions of links 22 when handle 16 is raised, with hose removed, to generally upright position past dead center with the center of gravity of the handle assembly still being within the base formed by the caster wheels as shown in FIG. 5. When so raised the position of handle 16 is stable and the washer may be stored conveniently occupying a minimum of floor or ground space. Stops 56 also have another function. When handle 16 is in operating position, as seen for example in FIGS. 2 and 3, a stop 56 will bear against the top edge of a link 22 on either the forward or rearward side of bearing bolt 26 to prevent the caster wheel assembly on that side from flipping over or tending to rotate completely around bearing bolt 26 should either the front or back wheel strike an obstruction or be otherwise radically elevated.

Figure 6:
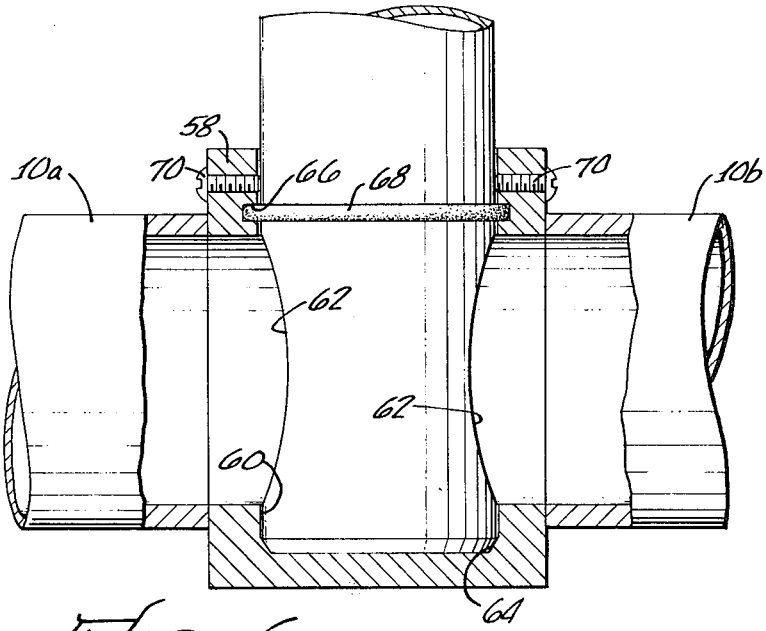
FIG. 6 shows, much enlarged, a broken-out view of the collar by which the hollow handle may be attached to the horizontal nozzle pipe.

Attachment of hollow handle 16 to pipe 10 is best seen in the enlarged view of FIG. 6. As shown, pipe 10 is fabricated as two sections 10a and 10b which are each attached and sealed, as by welding or threading, to central collar 58 which is provided with bore 60 having an open top and a closed bottom. The lower portion of hollow handle 16 is provided with apertures 62 which are aligned with the interiors of pipe sections **10*a* and 10*b* for communication therewith. The bottom of bore 60 is arranged with a tapered seat 64 in which mates the bottom or base of hollow handle 16. Seated in a conventional groove 66 in the upper part of collar 58 is resilient O ring 68 by which hollow handle 16 is sealed to collar 58 and thus to pipe sections 10*a* and 10*b*. Threaded through an upper part of collar 58 and in the way of the passage there-through of hollow handle 16, is at least one, and preferably two, set screws 70 whose inner ends can be adjusted to bear tightly against the outer surface of hollow handle 16 to hold it firmly in place as shown. The bottom end or base of hollow handle will be maintained fixedly in place by its mating with tapered seat 64. Therefore hollow handle 16 will be held immovably within collar 58 and cannot rock or shift in spite of its length even though there may be some clearance between the outer surface of hollow handle 16 and the inner surface of bore 60. This feature is important since it allows use of a grade of tubing for fabrication of hollow handle 16 which may notable produced to extremely rigid tolerances, and which may be, for this reason, considerably less expensive. When set screws 70 are loosened, hollow handle 16 may be withdrawn from collar 58** and thus demounted; and the handle and the base with its casters may be arranged as a much more compact package for shipping.

In operation a hose 20 supplying water under elevated pressure from a source, not shown, is attached by connector 18 to hollow handle 16 thus supplying water under pressure to pipe 10 and nozzles 14. The effluent spray may be directed in a somewhat flatter pattern by maintaining handle 16 in a lower position as in FIG. 2 or may be directed in a more nearly vertical and stronger stream by raising the handle as shown in FIG. 3. Regardless of the handle and dependent spray angle, the washer may be moved over the surface on which it is placed in any direction, forwards, backwards, sidewise, or in any intermediate direction. It will move freely because the caster support for nozzle pipe 10 is horizontally stable, the four caster pivot shafts are always vertical (with respect to the surface), and the caster wheels can swing or pivot to align themselves with any direction.

The ability to be moved easily in any direction while the spray angle may be adjusted to any desired angle (within the limits of the design) is an extremely important advantage of this invention.

Another advantage is the preferred link arrangement by which the nozzle supply pipe is rotated. As will be seen by comparison of FIG. 2 and FIG. 3 as the handle 16 is raised as in FIG. 3 to direct the spray more downwardly the nozzles themselves are moved closer to the ground or surface being washed. Thus a more direct spray originating from nozzles closer to the surface can be employed to blast at refractory accumulations of dirt or debris. As the handle is lowered the link rotates the pipe to point the nozzles further away from the washer and at the same time raises the nozzles away from the surface being washed so that they are better placed to direct the sprays over an area which is further away.

Surprisingly I have found that antifriction bearings, such as ball bearings, in the caster assemblies do not provide the best and easiest movement for the surface washer. The washer sprays water in large volumes and is intended for washing dirt and foreign materials from various surfaces. Antifriction bearings tend to pick up water and dust and dirt in their ballraces under these conditions, and cannot because of cost and use limitations, be equipped with elaborate seals. The common bearing with the closed socket without any oil hole or other opening at the top, mating with the hemispherically beaded pivot shaft solves the problem completely and allows movement in any direction with far less effort over any extended use period than can be obtained with antifriction bearings as normally employed in casters. The pivot shaft heads are well greased during assembly and, since there is no opening or oil hole in the socket for water or dirt to enter, the top bearing surfaces and lubrication remain clean for an extended period of time, and for practical purpose, almost indefinitely.

The outward angulation of the front frame portions of the caster assemblies is advantageous to provide a wider track or stance for the front part of the washer and combined with the casters spaced apart at the rear provides excellent stability with all-direction mobility. Additionally, the arrangement shown with the casters spread in front but with the nozzle pipe rotatably attached to the supports for the narrower track rear wheels, is economical in use of the nozzle pipe length. Also, outward placement of the front casters keeps them further removed from water and incidental spray from the outer edge nozzles and contributes to their long life without attention or re-lubrication. The wider stance of the front pair of casters has still another advantage. When the washer is moved with a pair of side casters close to a curb or building, for example, nozzle pipe 10 is angled somewhat rearwardly at its outer end. This directs water sprays from nozzles 14 in a general or over-all direction somewhat outwardly from the curb or building. The result is an improved cleaning action to sweep leaves, dirt and other debris away from the corner or intersection of the curb or building side with the surface being washed.

I claim:

1. A surface washer comprising a horizontal pipe fitted with a plurality of spaced apart nozzles, casters for moving said pipe over a surface to be washed, a hollow handle attached to said pipe for rotating said nozzles at various angles to said surface and for supplying water under elevated pressure to the interior of said pipe; in which the improvement comprises:

a. said horizontal pipe being supported by a plurality of at least three casters to obtain a horizontally stable support, a caster assembly comprising at least one caster supporting each end of said pipe; and, b. said horizontal pipe being rotatably attached to said caster assembly supporting each of its ends by a link having one of its ends fixedly attached to one of said caster assembly and said end of said horizontal pipe, and having its other end rotatably attached to the other of said caster assembly and said end of said horizontal pipe.

2. A surface washer according to claim 1 in which each end of said pipe is supported by a caster assembly comprising two casters spaced apart from front to back.

3. A surface washer according to claim 2 in which said caster assemblies each comprise a frame, said frames having rear parallel sides each carrying one caster and outwardly angled front side portions each carrying one caster.

4. A surface washer according to claim 3 in which each of said links has one end fixedly attached to one end of said pipe and the other end rotatably attached to one of said caster assembly frames.

5. A surface washer according to claim 4 in which a stop is arranged on each of said frames to limit rotation of said links with respect to said caster assemblies.

6. A surface washer according to claim 5 in which said stops are placed above and forward of the attachment of said links to said frames to maintain said handle in stable upright position when rotated upward past dead center.

7. A surface washer according to claim 1 in which each of said casters is pivoted on a shaft mounted in a common bearing, said shaft having a head rotatable in a closed socket.

8. A surface washer according to claim 7 in which the said shaft on which each of said casters is mounted has a generally hemispherical top rotatable in a closed mating socket.

9. A surface washer according to claim 1 in which said hollow handle is attached to said pipe by a collar having a base with an open top and a closed bottom having a tapered seat, the lower portion of said hollow handle passing through said base with its bottom mating with said seat, the hollow handle being held firmly in place at its passage through the open top of said base by at least one set screw threaded through an upper portion of said collar.

10. A surface washer according to claim 9 in which a pair of set screws are threaded through an upper portion of said collar to hold said hollow handle firmly in place.

* * * * *